US007216576B2

(12) United States Patent
Henry et al.

(10) Patent No.: US 7,216,576 B2
(45) Date of Patent: May 15, 2007

(54) TRAMPOLINE RESPONSIVE ARMOR PANEL

(76) Inventors: James Jackson Milham Henry, 6995 SW. Highland Ct., Wilsonville, OR (US) 97070; Russell Allen Monk, 220 Culver La. South, Salem, OR (US) 97302; Lance Allen Hicks, 1030 Fairview Ave., Salem, OR (US) 97302

( * ) Notice: Subject to any disclaimer, the term of this patent is extended or adjusted under 35 U.S.C. 154(b) by 160 days.

(21) Appl. No.: 11/067,530

(22) Filed: Feb. 25, 2005

(65) Prior Publication Data

US 2005/0193667 A1 Sep. 8, 2005

Related U.S. Application Data

(60) Provisional application No. 60/548,716, filed on Feb. 27, 2004.

(51) Int. Cl.
*F41H 5/04* (2006.01)

(52) U.S. Cl. ..... 89/36.02; 109/49.5

(58) Field of Classification Search ..... 89/36.02; 428/911; 109/49.5; 52/783.1
See application file for complete search history.

(56) References Cited

U.S. PATENT DOCUMENTS 2,758,952 A * 8/1956 Toulmin, Jr. ..... 428/630
3,974,313 A 8/1976 James
4,633,756 A * 1/1987 Rudoi ..... 89/36.02
4,648,136 A 3/1987 Higuchi
4,911,061 A 3/1990 Pivitt et al.
5,545,455 A * 8/1996 Prevorsek et al. ..... 428/76
5,974,585 A * 11/1999 Bachner, Jr. ..... 2/2.5
6,131,193 A * 10/2000 Bachner, Jr. ..... 2/2.5
6,298,765 B1 10/2001 Dvorak
6,314,858 B1 * 11/2001 Strasser et al. ..... 89/36.02
6,571,677 B1 * 6/2003 Kaura ..... 89/36.02
6,895,851 B1 * 5/2005 Adams et al. ..... 89/36.02
6,899,009 B2 * 5/2005 Christiansen et al. ..... 89/36.02

FOREIGN PATENT DOCUMENTS

WO WO 03/089869 A2 10/2003
WO WO 03/089869 A3 10/2003

* cited by examiner

*Primary Examiner*—Michael J. Carone
*Assistant Examiner*—Bret Hayes
(74) *Attorney, Agent, or Firm*—Jon M. Dickinson, PC; Robert D. Varitz, PC

(57) ABSTRACT

An armor panel for defeating a projectile strike including (a) a substantially planar core structure having spaced, generally parallel-planar strike and opposite faces, and elongate, circumsurrounding edge structure extending generally normally between these faces to define a perimeter for the core structure, (b) stranded core-wrap structure substantially fully enveloping the core structure, and possessing elongate, tension-load-bearing (TLB) strands which extend at angles relative to one another across the mentioned faces, and substantially parallel to one another in a distribution along the perimeter defined by the edge structure, and (c) a high-elastomeric coating which is distributed over at least those portions of the core-wrap structure which are disposed adjacent the strike face and the edge structure.

18 Claims, 5 Drawing Sheets

TRAMPOLINE RESPONSIVE ARMOR PANEL

CROSS-REFERENCE TO RELATED APPLICATION

This application claims priority to prior-filed, now abandoned, U.S. Provisional Patent Application Ser. No. 60/548,716, filed Feb. 27, 2004, for "Armor Manufacturing Process". All of the disclosure content of that provisional case is hereby incorporated herein by reference.

BACKGROUND AND SUMMARY OF THE INVENTION

This invention pertains to an anti-projectile, anti-spall, anti-ricochet, trampoline-action armor panel. In particular, it pertains to such a panel which is formed preferably with a plural-layered armor core, or core structure, including a hardened-material tile strike layer, and a plurality of armoring back-up flexure, or flex, layers (or at least one such layer) arranged in a stack, with lateral edges in the stack bound against motion relative to one another. The panel of the invention further includes a load-managing, stranded, around-the-core enveloping core-wrap of a special nature, with a coating provided on the outside at least of the lateral edges and of the strike face of the panel, which coating is formed of a high-elastomer, self-puncture-healing and energy-dissipating material, which, as will be discussed, and among other things, enhances trampoline action in response to a projectile strike.

In further general terms, the panel is constructed preferably with a modular, tile-like configuration so that it can easily be organized with other modularly-related similar panels to form a protective shield on, adjacent, etc., a selected site or object. Appropriate attaching structure/mechanism may be suitably integrated into the panel during its construction, if desired, for enabling ready mounting and attaching of the panel in its intended operative location.

The mentioned back-up layers may be employed in different numbers depending upon the projectile threat level to which the panel's use is directed, and these back-up layers are preferably each formed with plural sub-layers of appropriately disposed aramid fibers, preferably in a fabric weave, which are suitably facially bonded internally to unify the layer. The hardened-material, preferably ceramic-tile, strike layer which defines the projectile strike side of the panel of this invention is preferably formed as a row-and-column array of smaller ceramic tile units. These tile units are disposed substantially in edge-adjacent-edge, slightly edge-spaced, lateral adjacency, with an appropriate, shock-absorbing, elastomeric binder resin disposed between these edges to maintain a desired slight amount of spacing between adjacent edges in order to minimize lateral telegraphing of impact shattering and fragmentation of one tile to its neighbors. This same resin is employed to bind the strike layer to one facial side of the stack of adjacent back-up layers, and the core-wrap structure to the opposite facial side of the back-up layer stack.

The edge binding, or anchoring, of the lateral edges of all of the back-up layers in the core of the panel of this invention via a suitable hot-melt adhesive effectively converts substantially the entire lateral edge perimeter (the perimetral boundary) of the back-up layer portion of the core into a non-relative-motion singularity. This singularity prevents these edges effectively from moving relative to one another during response to an impact, while at the same time permitting a kind of trampoline-like, broad-beam flexing across the broad expanses of all of the back-up layers collectively. The bound edge structure further accommodates interfacial sliding motion between the confronting faces (facial expanses) of these layers as a consequence of a projectile impact event. This edge-bound structure thus renders, or characterizes, a unique core arrangement which responds with what is referred to herein as trampoline-broad-beam, slide-face behavior. One way of thinking about, or visualizing, how this beam-like characterization/analogy attaches to the structure of the invention is to imagine viewing any number of transverse cross-sectional sections taken through the core stack of layers in any plane which effectively intersects the planes of these layers at right angles. Doing this, one will notice that what one sees in each of these view planes is an elongate, laminar, beam-like "section" with opposite ends effectively locked into unified and interconnected structures (the entire bound perimeter), and with central, laminar stretches between these ends bendable in response very much like what one would observe in the behavior of an elongate, double-end-supported beam structure in, for example, the frame of a building.

The stranded core-wrap structure employed herein is one wherein two, wrapped, fabric-like components are employed, each having what is referred to herein as a load-transmitting grain direction (a fiber-based direction) which is effectively defined by elongate, substantially parallel, elongate, tension-load-bearing (TLB) fibers, preferably aramid fibers. These elongate TLB fibers in each wrap component substantially parallel the grain direction of the component. The two wrap components are organized into overlapping adjacency with respect to one another in such a fashion that (a) their respective grain directions are disposed at angles, and preferably at right angles, relative to one another at the two locations where these two components extend across the broad faces of the panel of this invention, and (b), these same grain directions are aligned in a common direction along the lateral edges of the panel, and specifically in a common direction which extends substantially normally between what can be thought of as the planes of the strike and opposite faces of the finished panel.

Significantly, the portions of the core-wrap structure which lie adjacent the bound edges of the back-up layers are adhered thereto, and this arrangement aids, as will be explained, in the trampoline response action of the panel of the invention. Additionally, in the region where these two core-wrap components centrally cross and overlap one another, they are anchored to that side of the stack of back-up layers which faces away from the strike layer of ceramic tiles.

The mentioned high-elastomer coating, which may be applied to the entirety of the surface areas of all sides of the panel of this invention, but which in the specific embodiment described herein extends over only the strike side and the lateral edges of the disclosed panel, operates as a significant energy dissipater with respect to an impacting projectile, such as a bullet, a fragmentation shrapnel-like shard, etc. This elastomer coating also integrates mechanically with the core-wrap structure, as will be explained, and co-acts therewith, along with the edge-bound core-structure back-up layers, via the connections which exist between these layers and the core-wrap structure, to enhance the broad-beam trampoline-response behavior of the overall panel.

In testing and observing the responses of many panels constructed in accordance with the teachings of this invention, we have observed that this panel not only is very effective in its role of defeating an incoming projectile threat, but also, after an impact has occurred, is strongly effective in preventing post-impact threat developments arising from spall. In other words, it does not allow the regeneration, so-to-speak, of fragmentation projectiles due, for example, to the breaking up of an incoming impacting projectile, or the breaking up of an internal armoring tile. Put another way, the panel appears to swallow/contain both impacting threat projectiles and the resulting internal fragments which may develop (as by bullet break-up and tile shattering) as a consequence of a received impact. The panel also is effective in greatly minimizing ricochets. Further, and as will be mentioned again later, the cooperative relationship which exists between the outer elastomer coating and the core-wrap structure, appears to handle an internal, blast-like, pressure-wave event, which immediately follows a projectile impact, in a unique outward-bulge-and-return manner.

All in all, the structure of the panel of this invention operates with a unique, broad-beam, trampoline-like and related actions which deal with a projectile impact through internal tile fragmentation to "burn" energy and break up a projectile, through energy dissipation occurring in the response provided by the elastomer layer, through broad-beam, trampoline-like flexure and yielding deflection which occurs in the behavior of the stacked assembly of the back-up layers included in the panel core, and through the bulge-and-return behavior just mentioned above. As will be seen, and as has been noted earlier, trampoline response is enhanced by the presence in the panel of the elastomer outer coating which is anchored to the panel edge regions in the immediately underlying core-wrap fabric structure.

Further, because of the unique edge-to-edge, resin-filled, shock-absorbing spacing which characterizes the strike layer of the employed hardened-material (ceramic) tile array, fragmentation of a directly hit tile effectively does not telegraph to its neighbors. Thus the armor panel of this invention has demonstrated a remarkable ability to receive and disable multiple, closely-spaced projectile impacts.

These and various other features and advantages which are offered by the invention will now become more fully apparent as the description which shortly follows is read in conjunction with the accompanying drawings.

While those skilled in the art will recognize from the description of this invention which now follows that various specific materials may be employed in different regions of the structure of the present invention, there are certain preferred materials upon which we have settled, and we here identify those materials.

IDENTIFICATIONS OF PREFERRED MATERIALS

Among the preferred materials employed in the construction of the preferred embodiment of the panel of this invention are the following:

1. Fabric (woven material) with the so-called TLB strands that define a grain direction in the two elongate core-wrap components of the core-wrap structure is a woven aramid fiber fabric made by Hexel Schwebel of Anderson, S.C.—a 3000-Denier material which is designated Configuration #745.

2. The same fabric is employed in single sub-layers (five are illustrated) to create the five, individual, integrated, stacked back-up layers employed in the illustrated and described core structure of the invention.

3. Centrally bonding the two core-wrap components (a) to one another, and (b) to one face of the non-strike side of the stack of back-up layers is a 2-part resilient urethane resin material made by Development Associates, Inc. of North Kingstown, R.I. This is referred to by its manufacturer as A-Z-7050-15A and B-Z-7050-15B.

4. Bonding facially adjacent sub-layers in each back-up layer structure is a 0.003-inch thick, heat-sensitive adhesive layer also made by Hexel Schwebel, called Hexform. Conveniently, this adhesive may be prepared as an initial coating on the aramid-fiber fabric material.

5. The ceramic tiles used in the so-called strike layer in the panel of this invention are each made of aluminum oxide (98.5%).

6. Edge bonding of the back-up layers herein is handled by a suitable and conventional hot-melt adhesive, which adhesive is also employed to bridge and bond adjacent edges in the wrapped, two core-wrap components which collectively make up the core-wrap structure.

7. Bonding the ceramic tile (strike) layer to one face in one of the back-up layers is the same resilient urethane material mentioned above for bonding the two employed core-wrap components. This same material occupies the spaces provided between next-adjacent, confronting edges of tiles in the tile layer.

8. The over-coating elastomer product, which is formed with a thickness herein of about 0.1-inches to about 0.125-inches, is made of a self-puncture-healing material sold under the trademark TUFF STUFF®, manufactured by Rhino Linings USA, Inc. in San Diego, Calif.

RELEVANT BACKGROUND LITERATURE

Useful in providing relevant background information regarding the present invention is published PCT Patent Application No. WO 03/089869 A2, published Oct. 30, 2003. Accordingly, the entirety of that document is hereby incorporated herein by reference for background purposes.

DETAILED DESCRIPTION OF THE INVENTION

Turning now to the drawings, and referring first of all to FIGS. 1–3B, inclusive, 14 and 15, indicated generally at 20 is an armor panel, referred to herein as a trampoline response armor panel, and as a trampoline broad-beam anti-projectile-strike armor panel, constructed in accordance with the present invention. As can be seen, panel 20 is substantially square in relation to its "broad-area" footprint, and planer in nature (see plane 20A in FIG. 3A), with illustrative dimensions herein of about 10×10×0.75-inches. These dimensions are matters of design choice, with thickness being determined chiefly by the intended "defeating" capability of the panel relative to a projectile, such as a bullet, a shard of shrapnel, etc., and the lateral dimensions being determined principally by the "site" to which it is to be attached to provide protection. It should be understood that the panel's footprint need neither be square, nor for that matter rectilinear. The panel's thickness herein is designed to protect against a projectile threat which is somewhat in excess of that produced by a typically fired AK47 round of ammunition. Accordingly, the panel specifically illustrated and described herein is to be considered to be merely illustrative.

Figure 15:
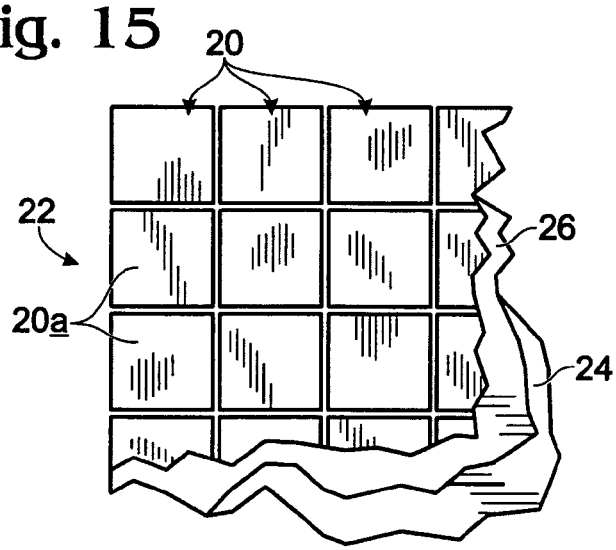
FIG. 15 is a fragmentary and simplified view illustrating an armoring installation employing a plurality of panels constructed in accordance with the present invention adhered to the surface of a structure which is to be protected through a pressure-sensitive adhesive layer.

Conveniently, it may be desirable to think of an armor panel made in accordance with this invention to be a versatile module to be incorporated in an armoring installation wherein it is arrayed with size-and-configuration-compatible other panels to form an overall armoring barrier. FIG. 15 shows fragmentarily a tiled, row-and-column array 22 of plural panels 20, attached to a structure 24, which is to be barriered, by a suitable film 26 of a pressure-sensitive adhesive. It should be understood, of course, that panels 20 may be prepared in a wide variety of ways for in-place attachment, and may also, if desired, be manufactured with "integral" attaching devices, mechanisms, etc. which themselves form no part of the present invention.

In general, high-level terms, panel 20 includes what are referred of herein as generally parallel-planar strike-and non-strike faces, or sides, 20*a*, 20*b*, respectively, which are bridged, so-to-speak, by four, orthogonally related (both to each other and to sides 20*a*, 20*b*) edges 20*c*, 20*d*, 20*e*, 20*f*.

In terms, generally, of the componentry which makes up panel 20, included are a planar armor core, or core structure, 28, a stranded core-wrap structure 30 which preferably completely envelops core 28, and an outer, high-elastomeric, surface coating 32 which, herein, only covers strike face 20*a* and edges 20*c*, 20*d*, 20*e*, 20*f* in panel 20. This surface coating could, naturally, be applied to cover the entire panel if desired. Preferably, it at least covers the specific panel portions just mentioned. Core 28 is also referred to herein as an impact reaction core.

Core 28 in panel 20, as illustrated, is formed as an edge-aligned stack of six, substantially planar layers, including a strike layer 34, and five back-up layers, or layer elements, 36, 38, 40, 42, 44. The five back-up layers are also referred to herein as slide-face layers, and as flex-response layers. Strike layer 34 possesses what are termed herein substantially parallel-planar strike and non-strike sides, or faces, 34*a*, 34*b*, respectively, with strike face 34*a* disposed toward previously mentioned panel strike side 20*a*, and with the mentioned back-up layers being located as a collection adjacent the non-strike face of layer 34. Layer 34 is also referred to as a flex-response layer. The lateral edges of the various layers included in the stack of layers which make up core structure 28 are essentially aligned with one another in edge planes which are disposed substantially normally relative to the planes of these layers.

Layer 34 herein is specifically formed as a row and column "tiled array" of square-footprint, hardened-material (preferably ceramic) tiles 46, each having dimensions in panel 20 of 2×2×0.275-inches. A preferred ceramic material employable in these tiles was mentioned earlier herein.

Figure 3A:
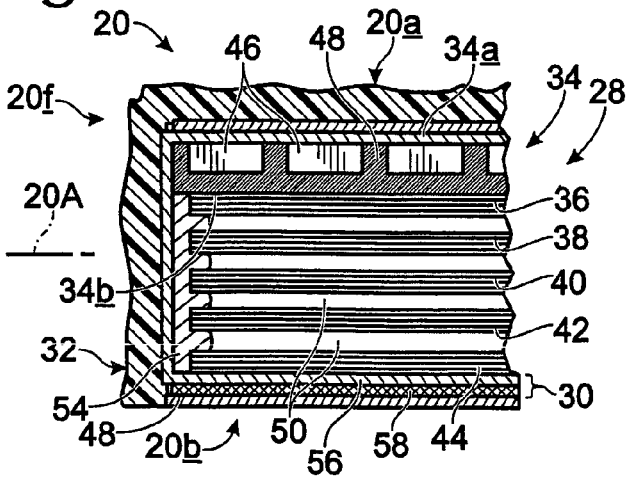
FIG. 3A is a cross-sectional view, presented on a larger scale than that employed in FIG. 2, and drawn without specific regard to exact relative proportions of components, taken generally along the line 3A—3A in FIG. 2.
Figure 14:
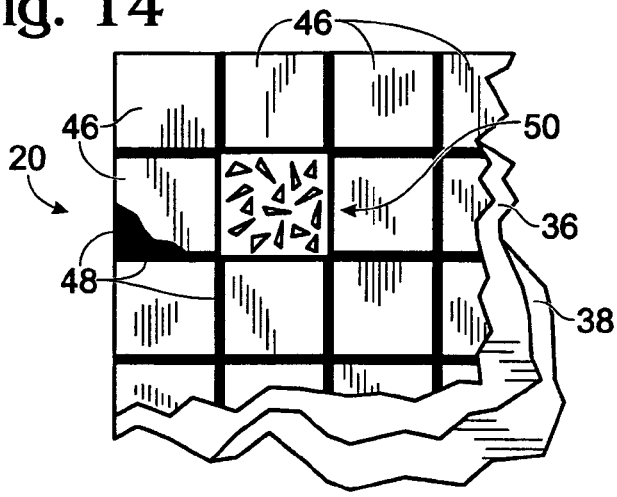
FIG. 14 is an enlarged fragmentary and stylized drawing illustrating how strike-fragmentation of a single tile in the strike layer contained in the panel of this invention is prevented from telegraphing its fragmentation to adjacent strike-layer tile neighbors.

Looking for a moment particularly at FIGS. 3A and 14, next-adjacent, confronting edges in tiles 46 do not contact one another. Rather, they are spaced apart in layer 34 by about 0.002- to about 0.005-inches, with the linear spaces between tiles being filled with a resilient, shock-absorbing, urethane interface material 48 whose preferable choice for use was also mentioned earlier. The edge arrangement of tiles 46 in panel 20 is referred to herein as being one possessing an edge-adjacent-edge configuration. Material 48, in a layer thickness herein of about 0.02-inches, also (a) binds strike layer 34 to the top face of back-up layer 36 (see particularly FIG. 3A), and (b) the lower face of back-up layer 44 to core-wrap structure 30 (see particularly FIG. 4).

Among the more important contributions made to the performance of the panel of this invention by this just-discussed tile spacing and inter-tile-edge disposition of urethane resin, is that a projectile impact which shatters a particular tile, such as the shattered tile shown in FIG. 14 at 50, does not telegraph this shatter event to its neighbors. More will be said about this feature of the invention later.

Figure 3B:
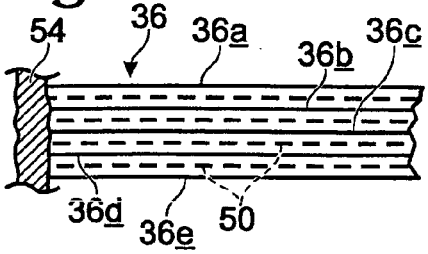
FIG. 3B is a further enlarged fragmentary portion of FIG. 3A illustrating details of construction of a back-up layer in the panel of FIGS. 1–3A, inclusive.

Each of the five back up layers employed in panel 20 is formed by the integration of five, individual sub-layers of the woven, aramid-fiber fabric material described earlier herein. In FIG. 3B, back-up layer 36 is shown with five such sub-layers 36*a*, 36*b*, 36*c*, 36*d*, 36*e*. Preferably, one or both of the facial expanses of these layers which confront and face one another in layer 36 is (are) pre-coated with the heat-sensitive adhesive material also referred to herein earlier as being made by the Hexel Schwebel company. Through appropriate heat application during the preparation of the back-up layers, the individual sheets making up each one these layers become bonded through the heat reaction generated in the mentioned heat-sensitive adhesive. In FIG.

3B, dashed lines 52 represent this adhesive material. In the regions where this adhesive material is employed, its thickness between components is about 0.003-inches.

Implementing edge-to-edge binding of the stack-aligned lateral edges in layers 36, 38, 40, 42, 44, according to an important feature of the invention, is what is referred to herein as edge-to-edge binding structure 54. In the embodiment of the invention now being described, structure 54 takes the form of the earlier mentioned conventional hot-melt adhesive material. This binding structure unifies the edges in the back-up layers to create an elongate edge singularity which acts as a non-relative-motion unit with respect to preventing any relevant motion from occurring between adjacent edges in the stack of back-up layers. As will be mentioned again herein a little bit further on in this description, this same hot-melt adhesive material binds adjacent edge regions in portions (components) of core-wrap structure 30.

Figure 1:
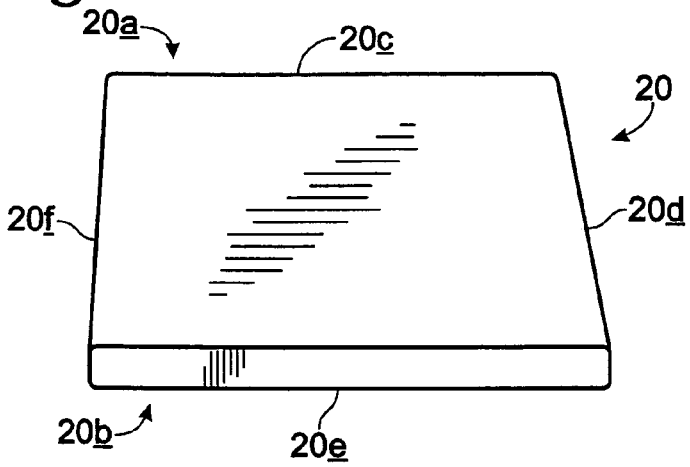
FIG. 1 is a top isometric view of a trampoline response armor panel constructed, and designed to perform in accordance with, the features of the of the present invention.
Figure 2:
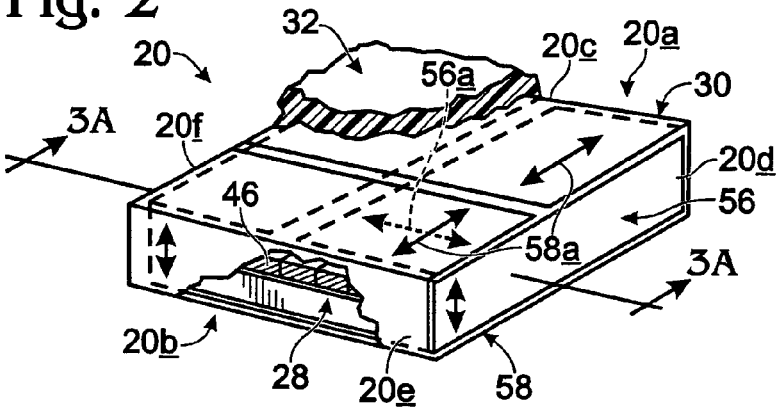
FIG. 2 is a reduced-scale, differently proportioned and partially fragmentary drawing illustrating certain general overall features of the panel of FIG. 1.
Figure 4:
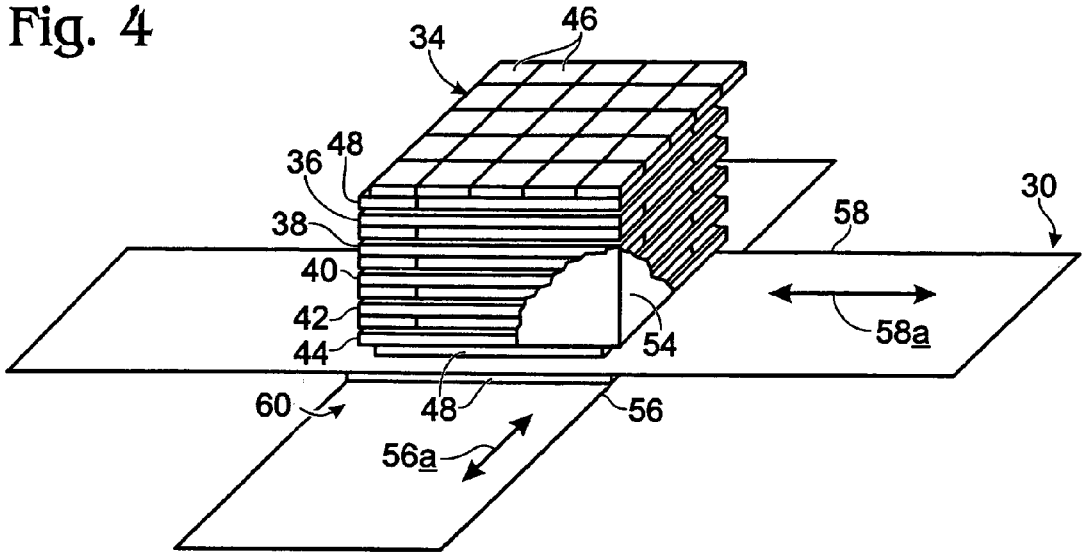
FIGS. 4–6, inclusive, illustrate, in a stylized fashion, several stages involved in the construction of the panel shown in FIGS. 1–3B, inclusive.
Figure 7:
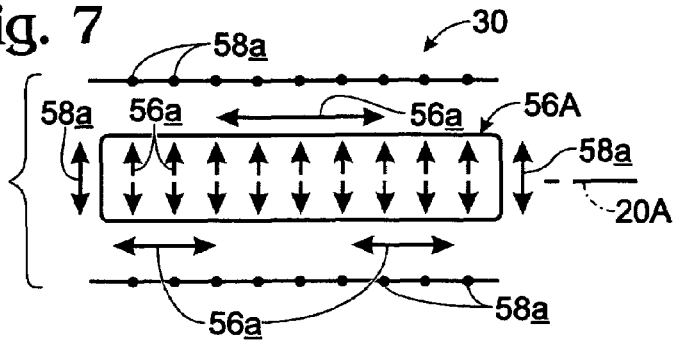
FIGS. 7–9, inclusive, are simplified and stylized drawings illustrating the proposed organization, in a core-wrap structure included the panel of this invention, of the so-called grain directions in a pair of stranded core-wrap components which form the mentioned core-wrap structure.
Figure 8:
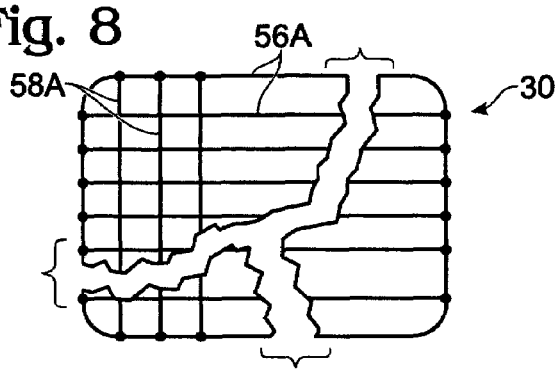
Figure 9:
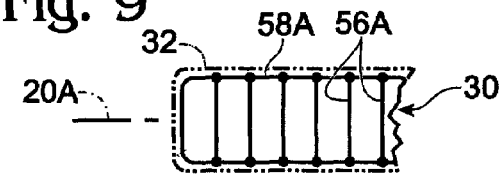

Previously mentioned core-wrap structure 30 herein takes the form of two elongate and generally orthogonally oriented core-wrap components 56, 58 which, where they centrally cross one another, as is illustrated generally at 60 in FIG. 4, are bonded to one another by the same two-part urethane material which was earlier given reference number 48. These two core-wrap components are formed from the same aramid fiber fabric material described earlier herein, and they are oriented relative to one another whereby the aramid fibers which extend generally in their (the components') long directions are referred to herein as tension-load-bearing, or TLB, fibers which effectively define what are also referred to herein as the grain directions for these two components. In FIGS. 2, 4 and 7, double-ended arrows 56*a*, 58*a* represent the extension directions, and thus the grain directions, of the TLB fibers in core-wrap components 56, 58, respectively. Several specific TLB fibers in components 56, 58 are shown in FIGS. 7–9, inclusive, at 56A, 56B, respectively.

What will be observed is that these TLB fibers in the two core-wrap components (56, 58) are disposed at angles relative to one another, and specifically preferably at right angles relative to one another, in those portions of the wrap components which extend effectively in the planes of the strike and non-strike sides of panel 20. This angularity is shown clearly in FIG. 8. Where, however, these core wrap components are folded to extend as respective continuums along the edges of panel 20, the grain directions, and the TLB strands, in both core-warp components parallel one another, and specifically extend generally normally between the planes of the opposite faces, or sides, of panel 20. This is clearly illustrated in FIGS. 7 and 8.

Those portions, or stretches, of TLB aramid fiber strands in the core-wrap components which extend essentially across the faces of panel 20 are referred to as being first stretch, or strand, portions of these fibers, and those portions which extend on and along the edges of panel 20, between the strike and non-strike sides of the panel, are referred to herein as being second stretch, or strand, portions of these same TLB strands. Within each TLB fiber, or strand, the so-called first and second stretches are continuums with respect to one another.

As was mentioned earlier herein, the portions of core-warp components 56, 58 which are disposed along the edges of panel 20*a* are bonded to material 54.

Completing a description of panel 20 per se, outer elastomeric coating 32 is formed herein by spraying onto the core-wrap structure the TUFF COAT® product mentioned above in the portion of this description which outlines preferred materials for use in the making of panel 20. This coating material, because of its extreme high elasticity, substantially closes back upon itself to self-heal a puncture wound. This behavior helps to capture and contain internally generated projectile and tile fragmentation to defeat spall.

Significantly, in the interfacial region between this coating and the engaged portions of the core-wrap components, there is established a robust, load-transmitting bond between these elements of panel 20. This bond is formed by mechanisms including (a) direct adhesion between the surfaces of the aramid fibers in the core-wrap components and the elastomeric coating, (b) flowing of the elastomeric material into the interstices between crossing strands in the weaves of the core-wrap components per se, and (c) capillary-action entrainment of a certain amount of elastomeric material within the bodies of the woven aramid fibers per se. This load-transmitting, intimate bonding relationship just described plays an important role in enhancing what is referred to herein as the trampoline-response behavior of panel 20 on the occurrence of a projectile strike on the strike side, or face, of the panel.

Figure 5:
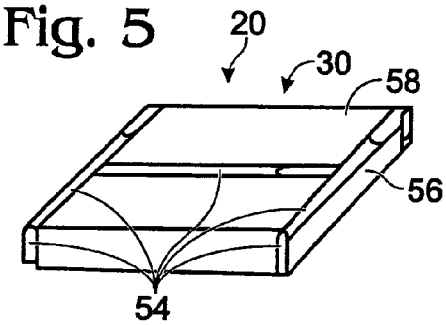
Figure 6:
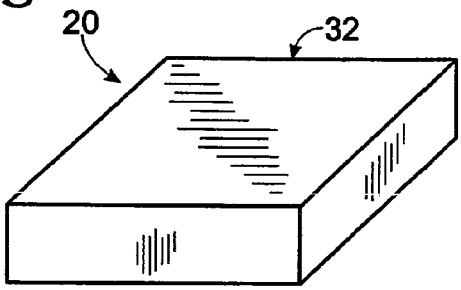

Turning attention now briefly collectively to FIGS. 4–6, inclusive, here there is very generally outlined an assembly process for panel 20. One should understand that components of the panel illustrated in these three figures are not necessarily drawn to scale.

FIG. 4 illustrates a preliminary assembly of almost all of the materials which make up panel 20, and specifically, with these materials in a condition ready for cross wrapping and folding of the two core-wrap components (56, 58) to envelop the stacked, layered core structure of the panel. FIG. 5 illustrates the assembly condition which exists after such core-structure enveloping, and hot-melt adhesive bonding, at appropriate locations, for the edges of the core-wrap components. FIG. 6 illustrates a condition after at least the strike face and the lateral edges of the structure of FIG. 5 have been sprayed with the desired, outer, high-elastomeric coating (32).

FIGS. 7, 8 and 9 effectively isolate from other structural components the fabric stranded structures of the two core-wrap components to illustrate the respective dispositions of their grain directions and TLB strands. The large darkened dots in these three figures represent TLB strands which extend essentially normally to the planes of these three figures.

Figure 10A:
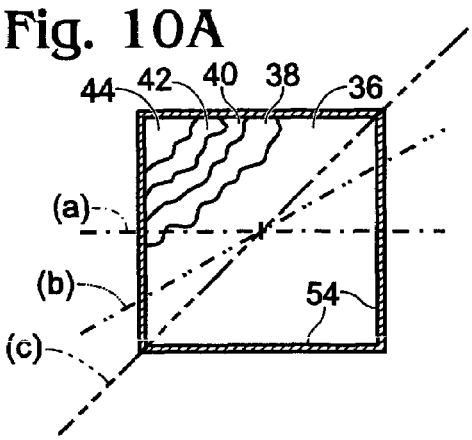
FIGS. 10A and 10B provide a pair of stylized schematic illustrations useful in understanding the "trampoline broad-beam" characterization of the armor panel of this invention.
Figure 10B:
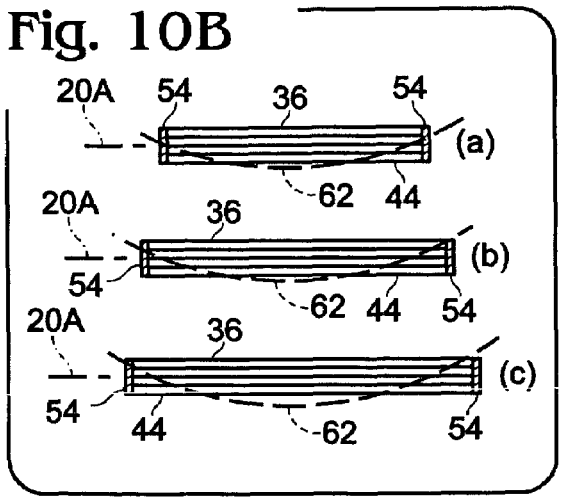

FIGS. 10A, 10B illustrate aspects of the broad-beam trampoline nature of, particularly, the edge bound back-up layers. The whole edge bound back-up layer assembly is shown in plan view in FIG. 10A, and in FIG. 10B, transverse cross sections are illustrated as taken along the three angularly offset view lines (a), (b) and (c) in FIG. 10A. What one can see in these three sectional views is that, with respect to every transverse section view (just three being shown) taken in a plane which is substantially normal to the nominal plane of the assembly of the back-up layers, the back-up layer assembly effectively looks like a laminated, elongate beam structure. Dashed, curved lines 62 in FIG. 10B illustrate "beam-bending" as a reaction response to an impact strike on panel 20. The fact that the entire perimeter edge structure of the assembly of back-up layers is unified by the earlier mentioned edge-binding structure results in the entirety of the assembly of back-up layers functioning somewhat like a broad-beam trampoline. The word "broad" is herein used to reflect the fact that each back-up layer provides a broad-area structure for responsive action.

Figure 16:
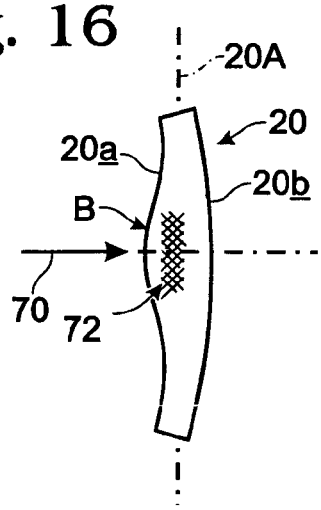
FIG. 16 is a simplified side elevation illustrating an observed momentary outward bulge which occurs after a projectile impact relative to the panel of this invention—a bulge which is believed to be involved in dealing with an internal pressure-wave, explosion-like event which occurs inside the panel of the invention.

Turning finally to FIGS. 11–13B, inclusive, and to FIG. 16, here, certain very simplified and schematic views are presented further to illustrate trampoline reaction response to the impact of a projectile. To simplify these two figures, strike layer 34 is omitted.

Figure 11:
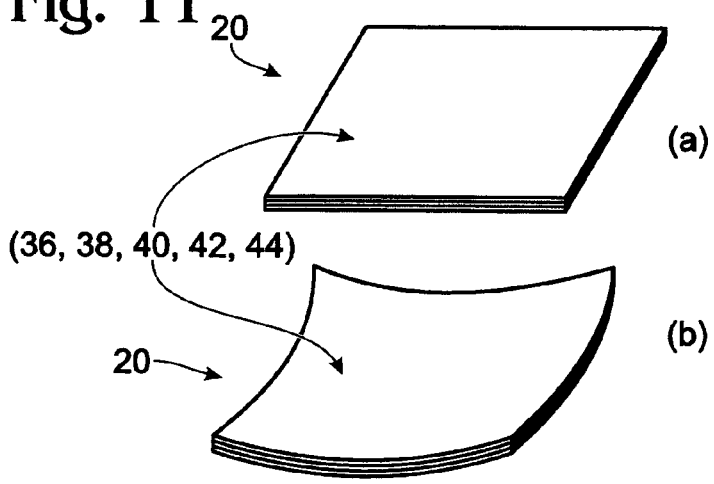
FIG. 11 provides two simplified isometric views of pre-impact and post impact conditions of a stack of back-up flex layers employed in the panel of the invention.

In FIG. 11, the upper view labeled (a) represents the back-up layer assembly in panel 20 in a planar and undeflected state before a projectile impact. The lower view labeled (b) illustrates a trampoline-like reaction downward bowing of panel 20 after an impact.

Figure 12:
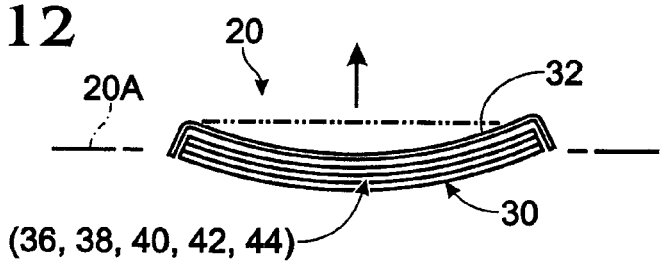
FIG. 12 is a simplified, schematic side elevation isolating, and illustrating the projectile-impact cooperative behavior's of, a stack of edge-bound back-up layers, of a core wrap structure which effectively envelopes these layers, and of a panel outer coating made of a high-elastomeric material.

FIG. 12 represents about the same projectile-reaction condition which is shown in the lower view in FIG. 11, picturing the relationship which exists between elastomeric coating 32, core-wrap structure 30, and the back-up layer assembly. Flexing and stretching of coating 32 "arms" the coating to spring back, so-to-speak, thus enhancing trampoline-response behavior of panel 20.

Figure 13A:
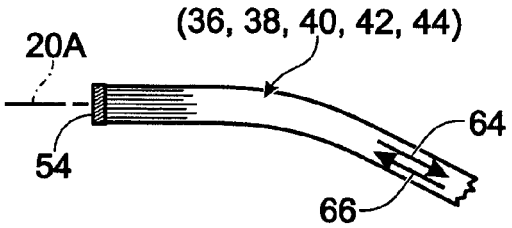
FIGS. 13A and 13B collectively illustrate certain aspects of a response to a projectile impact provided by the mentioned edge-bound back-up layers.

In FIG. 13A, two, oppositely directed arrows 64, 66 are placed over the edge image of a fragmentary potion of the assembly of back-up layers to illustrate the fact that, while the edges of the back-up layers are not permitted to move relative to one another, when the broad facial expanses of these layers flex in response to an impact, a facial sliding motion takes place, and is accommodated as the layers react to the impact. This sliding motion, through facial frictional engagement, serves to dissipate impact energy.

Figure 13B:
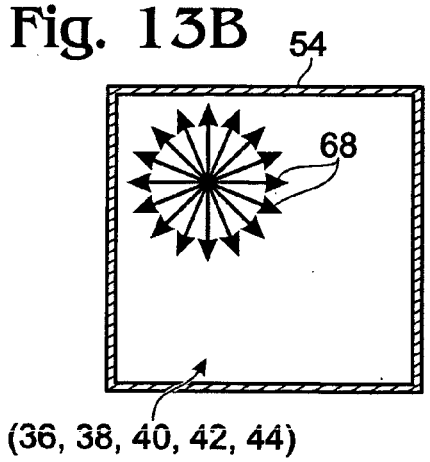

In FIG. 13B, here shown is a facial view of a projectile-created point impact which is non-symmetric with respect to the central region of the footprint of the assembly of back-up layers. Radially outwardly pointing arrows, such as those designated 68 in this figure, help to tell the story that the kind of slide-motion interaction which is permitted facially between adjacent layers in the collection of back-up layers develops substantially radially centrally with respect to the illustrated impact, thus relatively uniformly dissipating energy essentially symmetrically with respect to the point of panel/projectile impact.

FIG. 16 in the drawings, which presents a highly stylized and simplified edge view of panel 20, is provided herein to highlight an observed phenomenon involving the outward bulging, see B in FIG. 16, in the direction of a incoming and impacting projectile represented by an arrow 70. What is believed to result, momentarily and immediately after a projectile impact, is the internal generation of a kind of pressure-wave explosive event taking place inside panel 20 as a projectile enters, fragments a tile, and produces trampoline action. This explosion-like event is represented by the darkened patch shown at 72 in FIG. 16. This observed reaction of the panel of this invention strongly suggests that, in addition to its remarkable capability for defeating penetration damage by a projectile, the panel is also very well equipped, at least with respect to the cooperative performances of the core-wrap structure and the elastomer coating, to deal with broad area force events, such as a blast or explosion event.

Thus, a preferred embodiment of the armor panel of this invention has been described. The panel features unique cooperative relationships between (a) a layered core structure, including a tiled strike-layer, and a stack of edge-bound, slide-face fabric-material back-up layers, (b) a cross-grain, fabric-material core-wrap structure which envelops the core structure with specially "directed" tension-load-bearing, grain-direction fibers, and (c) an outer coating of a self-healing high-elastomeric material which is appropriately bonded to the core-wrap structure. Hardened-material tiles in the strike-layer are set in an elastomeric resin which inhibits shatter-telegraphing between tiles.

Following a projectile strike which is first greeted by the self-healing elastomeric coating, and then energy-dissipated by tile fragmentation, there follow a trampoline-like-energy-quelling response principally offered by the cooperative stack of flex back-up fabric layers which are specially edge bound against relative edge movement, but which are permitted to slide relative to one another in facial frictional engagement for further energy-dissipation action. Trampoline action is enhanced by load-transmission bonding which exists between the back-up core layers, the core-wrap structure, and the outer elastomeric coating.

While a preferred embodiment of, and manner of practicing, the invention are thus fully set forth herein, we appreciate that variations and modifications, such as material-type and component-count variations and modifications, may be made without departing from the spirit of the invention.

We claim:

1. An armor panel for defeating a projectile strike comprising a substantially planar core structure having spaced, generally parallel-planar strike and opposite faces, and elongate circumsurrounding edge structure which extends generally normally between and relative to said faces, and stranded core-wrap structure fully enveloping said core structure, and including a pair of cooperative wrap components, each having a preferential, load-transmitting grain direction, and each including plural, elongate, tension-load-bearing strands which generally parallel the wrap component's grain direction, each tension-load-bearing strand in each wrap component including first portions extending across, and generally in the respective planes of, said strike and opposite faces, and second portions extending generally normally relative to said faces, and across a pair of spaced locations in said edge structure, said first portions in the tension-load-bearing strands in each of said wrap components extending adjacent said core-structure faces at angles relative to the first portions in the tension-load-bearing strands in the other wrap component, and said second portions in all tension-load-bearing strands in said wrap structure extending generally parallel to one another in a distribution which extends substantially completely about the length of said edge structure.

2. The armor panel of claim 1, wherein said tension-load-bearing strands are formed of an aramid material.

3. The armor panel of claims 2, wherein said aramid material is a woven material in which said tension-load-bearing strands extend in one common direction within the weave of that material.

4. The armor panel of claim 1, wherein said core structure takes the form of plural layers, including a strike-face layer and at least one back-up layer.

5. The armor panel of claim 4, wherein each of said layers has edges, and at least one facial expanse confronting a facial expanse in a next-adjacent layer, and operatively disposed intermediate each pair of next-adjacent layers is edge-to-edge binding structure collectively unifying the layer edges in the panel to act effectively as a singularity, while unconstraining the capability in the panel for relative slide motion to occur between said confronting facial expanses as a result of panel flexure in response to a projectile strike engaged by said panel.

6. The armor panel of claim 5, wherein said strike-face layer is formed of an edge-adjacent-edge array of plural, spaced, hardened-material tiles, and said at least one back-up layer is formed of aramid fibers.

7. The armor panel of claim 6, wherein the spaces between confronting edges of next-adjacent tiles are substantially filled with a shock-absorbing interface material.

8. The armor panel of claim 7, wherein said interface material is elastomeric.

9. The armor panel of claim 8, wherein each of said layers has edges, and at least one facial expanse confronting a facial expanse in a next-adjacent layer, and operatively disposed intermediate each pair of next-adjacent layers is edge-to-edge binding structure collectively unifying the layer edges in the panel to act effectively as a singularity, while unconstraining the capability in the panel for relative slide motion to occur between said confronting facial expanses as a result of panel flexure in response to a projectile strike engaged by said panel.

10. The armor panel of claim 1, wherein said core structure takes the form of a stack of layers, including a strike-face layer and plural back-up layers.

11. The armor panel of claim 10, wherein said strike-face layer is formed of an edge-adjacent-edge array of plural, spaced, hardened-material tiles, and said back-up layers are formed of aramid fibers.

12. The armor panel of claim 11, wherein the spaces between confronting edges of next-adjacent tiles are substantially filled with a shock-absorbing interface material.

13. The armor panel of claim 12, wherein said interface material is elastomeric.

14. An armor panel for defeating a projectile strike comprising a substantially planar core structure having spaced, generally parallel-planar strike and opposite faces, and elongate, circumsurrounding edge structure extending generally normally between said faces to define a perimeter for the core structure, stranded core-wrap structure substantially fully enveloping said core structure, and possessing elongate, tension-load-bearing strands which extend at angles relative to one another across said faces, and substantially parallel to one another in a distribution along the perimeter defined by said edge structure, and a high-elastomeric coating which is distributed over at least those portions of said core-wrap structure which are disposed adjacent said strike face and said edge structure.

15. An armor panel for defeating a projectile strike comprising a core having spaced generally strike and opposite faces which lie in respective planes that parallel one another, and perimetral edge structure bounding the core and extending between said faces, and stranded core-wrap structure substantially completely enveloping said core and including, adjacent and across said faces, plural, elongate, first tension-load-bearing strand portions lying generally in first planes substantially paralleling the planes of said faces and at angles of intersection relative to one another, and further including, as structural load-bearing continuities with said first tension-load-bearing strand portions, plural, second, elongate strand portions lying generally in second planes disposed along said edge structure, which second planes intersect said first planes, and wherein said second strand portions are oriented all substantially parallel to one another.

16. The armor panel of claim 15, wherein further included is a high-elastomeric coating which is distributed over at least those portions of said core-wrap structure which are disposed adjacent said strike face and said edge structure.

17. An armor panel for defeating a projectile strike comprising a generally planar, plural-layer, impact-reaction, core having strike and non-strike faces, and including generally planar elements which are structured collectively to present, to an impacting projectile, and on said strike side face of the core, a perimetral boundary defined generally by lateral edges in the core elements, and stranded core-wrap structure substantially fully enveloping said core, and including facial expanses spanning each of said strike and non-strike faces in said core, and interconnecting edge expanses joined integrally as strand-extending continuums with said facial expanses, and spanning each of said perimetral-boundary-defining, core-element lateral edges, each strand in said wrap structure possessing continuous stretches including a first pair of stretch portions which lie adjacent each of said strike and non-strike faces, and a second pair of stretch portions which are integral with, and which extend between the stretch portions in said first pair, which second stretch portions lie adjacent spaced regions in said lateral edges.

18. An armor panel for defeating a projectile strike comprising a substantially planar core structure having (a) spaced, generally parallel-planar strike and opposite faces, (b) a plurality of generally planar flex layers disposed intermediate said faces, and including adjacent, core-perimeter-defining lateral edges, and confronting, layer-to-layer facial regions which are bounded by said edges, and (c) elongate, edge-binding structure unifying said edges without constraining next-adjacent ones of said facial regions against motion relative to one another, stranded core-wrap structure substantially fully enveloping said core structure, and possessing elongate, tension-load-bearing tension-load-bearing strands which extend at angles relative to one another across said faces, and substantially parallel to one another in a distribution along the core perimeter defined by said edges, said core-wrap structure being bonded to said edges effectively through said edge-binding structure, and a high-elastomeric coating distributed over and bonded to, at least those portions of said core-wrap structure which are disposed adjacent said strike face and said edges.

* * * * *

UNITED STATES PATENT AND TRADEMARK OFFICE

CERTIFICATE OF CORRECTION

PATENT NO. : 7,216,576 B2
APPLICATION NO. : 11/067530
DATED : May 15, 2007
INVENTOR(S) : Henry et al.

It is certified that error appears in the above-identified patent and that said Letters Patent is hereby corrected as shown below:

Title Item [54] is corrected to read: --TRAMPOLINE RESPONSE ARMOR PANEL--

In claim 17, column 12, line 16, delete the word "side"

Signed and Sealed this

Twenty-first Day of August, 2007

JON W. DUDAS
*Director of the United States Patent and Trademark Office*